United States Patent [19]

Fabris

[11] 4,373,367

[45] Feb. 15, 1983

[54] ROLLER ENTRY GUIDES FOR ROD MILLS

[76] Inventor: Mario Fabris, 8 Roberts Rd., Grimsby, Ontario, Canada, L3M 3X2

[21] Appl. No.: 207,317

[22] Filed: Nov. 17, 1980

Related U.S. Application Data

[63] Continuation-in-part of Ser. No. 80,820, Oct. 1, 1979, Pat. No. 4,295,356.

[51] Int. Cl.[3] ..... B21B 39/16

[52] U.S. Cl. ..... 72/250

[58] Field of Search ..... 72/227, 250, 251

[56] References Cited

U.S. PATENT DOCUMENTS 3,611,777 10/1971 Bretschneider ..... 72/249
4,295,356 10/1981 Fabris ..... 72/250

FOREIGN PATENT DOCUMENTS 2701381 7/1978 Fed. Rep. of Germany ..... 72/250
185325 8/1966 U.S.S.R. ..... 72/250
294658 2/1971 U.S.S.R. ..... 72/251

*Primary Examiner*—Francis S. Husar
*Assistant Examiner*—Jonathan L. Scherer
*Attorney, Agent, or Firm*—Hirons, Rogers & Scott

[57] ABSTRACT

A roller entry guide for a rod mill consists of a body with a funnel shaped entrance leading to a through bore for the rod. The exit is provided with two guide rollers each mounted on a rocker arm for adjustment of their spacing. Each guide roller has a ring of fluid reaction recesses at which a nozzle directs a stream of pressurized fluid, usually air, to keep the rollers rotating at operative speeds and prevent excessive wear and possible bearing failure, which can lead to cobbles in the rod. Each roller includes an annular outer member mounted on a central member by two spaced bearings, the outer races of which have radially projecting flanges engaged in counterbores in the annular outer member to automatically locate the parts together for rapid assembly and disassembly.

7 Claims, 4 Drawing Figures

ROLLER ENTRY GUIDES FOR ROD MILLS

CROSS REFERENCE TO RELATED APPLICATION

This application is a continuation in part of Ser. No. 080,820 issued Oct. 1, 1979 now issued as U.S. Pat. No. 4,295,356.

FIELD OF THE INVENTION

This invention is concerned with improvements in or relating to roller entry guides as used in mills for the production of metal rod from metal billets.

REVIEW OF THE PRIOR ART

Rod mills have now been well known for a considerable time and constitute a "mature" technology. A typical machine consists of about 5–8 stages, which progressively reduce the radial dimension of a heated metal billet fed to it. For example with a five stage machine the entering square cross-section billet may measure about 10 cm by 10 cm in transverse dimension and be about 10 meters in length, while the exiting round cross-section rod may be about 0.09 cm in diameter and about 4,000 meters in length. The rod therefore rapidly increases in linear speed as it passes through the mill to as much as about 4,000 meters per min (240 k.p.h.) in the final finish stand. The passage of each billet through the mill takes about 1½–2 minutes, and after 5–6 seconds a new billet is fed in.

Each stage of the mill consists of a reducing die having at its entry side a set of entry guide rollers, which receive the rod exiting from the preceding stand and direct it accurately into the die mouth. Such roller guides therefore work under extreme conditions, especially those in the two or three finish stands, in that they are impinged suddenly by the rod end and accelerated at an enormous rate to a high rotation speed, inevitably causing some skidding between the rod and rollers and consequent wear of the rollers and their bearings. It is impossible in practice to keep the mill and its surroundings clean and the roller bearings are exposed to the dirt in the ambient atmosphere, frequently resulting in bearing seizure and additional wear.

Such excessive wear and seizure can quickly result in situations where a cobble is produced in the rod. The difficulties and production loss in clearing a cobble are such that it is preferred to replace the guide rollers, at least at the finish stands, at regular intervals before such situations can develop. The normal conditions of operation are so severe that it is quite usual for such replacement to take place every eight working hours, resulting in considerable expense.

DEFINITION OF THE INVENTION

It is therefore an object of the invention to provide a new rod mill roller entry guide with which the wear and need for replacement are very substantially reduced, as compared with the known constructions.

It is also an object to provide a new such guide having a new bearing structure that simplifies and reduces the cost of manufacture thereof.

In accordance with the present invention there is provided a new roller entry guide for a rod mill comprising:

a body providing a rod passage therein through which the rod passes;

a pair of rocker arm members mounted by the body on opposite sides of the rod passage for pivoting rocking movement about respective parallel pivot axes;

a pair of guide roller members each mounted by the respective rocker arm member for rotation about a respective rotation axis, the pivoting rocking movement of the arm members permitting movement of the guide roller members toward and away from one another;

each guide roller member having a ring of fluid reaction members coaxial with its axis of rotation;

means disposed to direct a stream of fluid at the said ring of fluid reaction members to rotate the respective guide roller member about its axis of rotation; and means for feeding fluid to the said nozzle means whereby the guide roller members can be rotated at about their operative speeds prior to engagement by a rod passing through the device. Preferably the means disposed to direct the stream of fluid comprises a U-shaped bracket secured to said body through arms thereof and having the plane containing said arms perpendicular to a plane containing the rocker arms, a bore being provided in each arm having an inlet to receive compressed fluid and an outlet to direct the stream of fluid downwardly at said ring of fluid reaction members.

Also in accordance with the invention there is provided a roller entry guide for a rod mill comprising:

a body providing a rod passage therein through which the rod passes;

a pair of rocker arm members mounted by the body on opposite sides of the rod passage for pivoting rocking movement about respective parallel pivot axes;

a pair of guide roller members each mounted by the respective rocker arm members for rotation about a respective rotation axis, the pivoting rocking movement of the arm members permitting movement of the guide roller members toward and away from one another;

each guide roller member comprising:

a central member;

a pair of spaced bearings having their inner races mounted on the central member;

an outer member mounted on the outer races of the bearings with the bearings engaged in a bore therein;

wherein the bearings have radially projecting parts engaged in respective counterbores in the outer member bore to locate the bearings axially with respect to the central member and the said outer member bore.

DEFINITION OF THE DRAWINGS

A rod finishing mill roller entry guide assembly that is a particular preferred embodiment of the invention will now be described, by way of example, with reference to the accompanying diagrammatic drawings, wherein.

DESCRIPTION OF THE PREFERRED EMBODIMENTS

Figure 1:
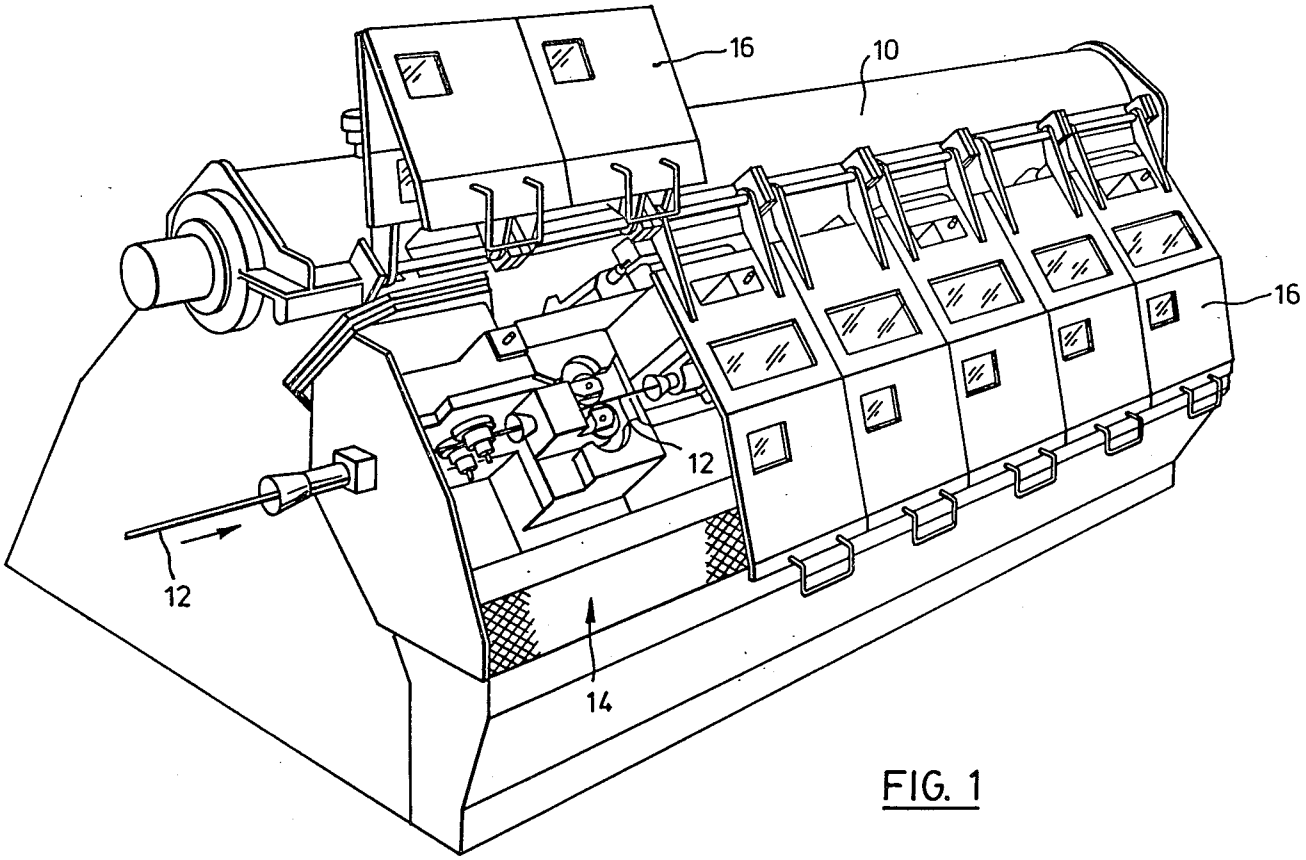
FIG. 1 is a general perspective view of a rod mill.

FIG. 1 shows a typical rod mill into which billets are fed at the left-hand side, as seen in the Figure, and from which circular cross-section reduced rod exits at the right-hand side into subsequent processing equipment which is not illustrated. The structure of the mill, apart from the roller entry guide assembly, is not important for an understanding of the invention and is not described in detail. The mill comprises a body 10 providing a linear path along which the rod 12 moves through seven successive reduction stages such as 14, each located beneath a respective movable protection cover 16.

Figure 2:
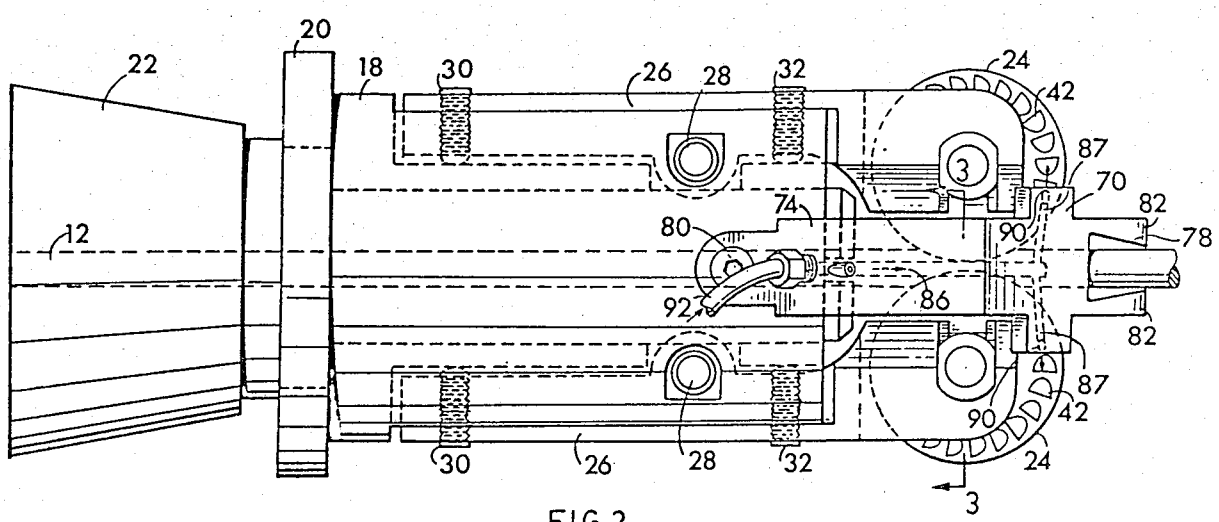
FIG. 2 is a plan view from above of the roller entry guide assembly, a part thereof being shown removed for clarity of illustration.
Figure 3:
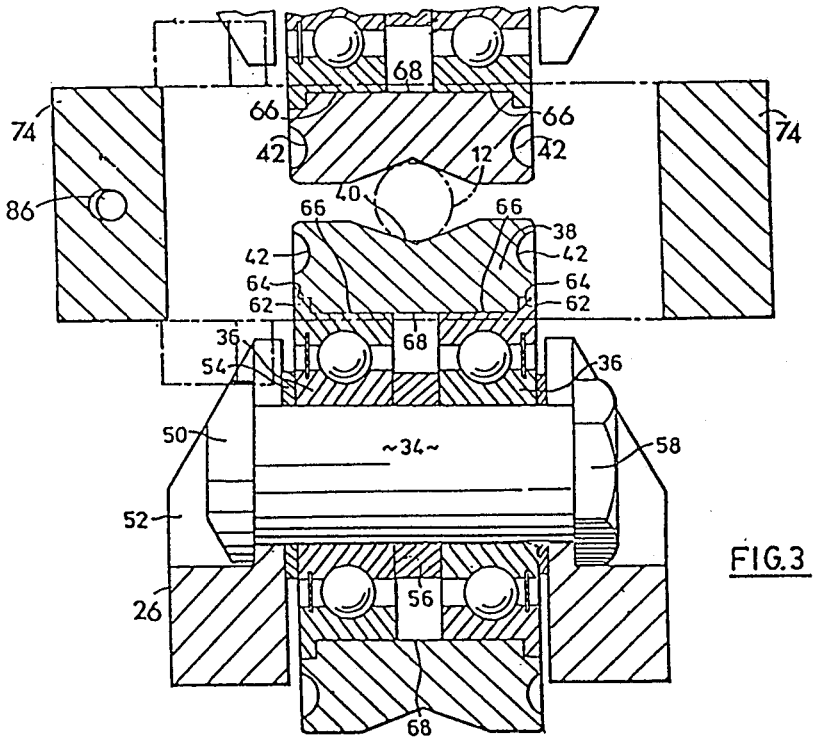
FIG. 3 is a section taken on the line 3—3 of FIG. 2.
Figure 4:
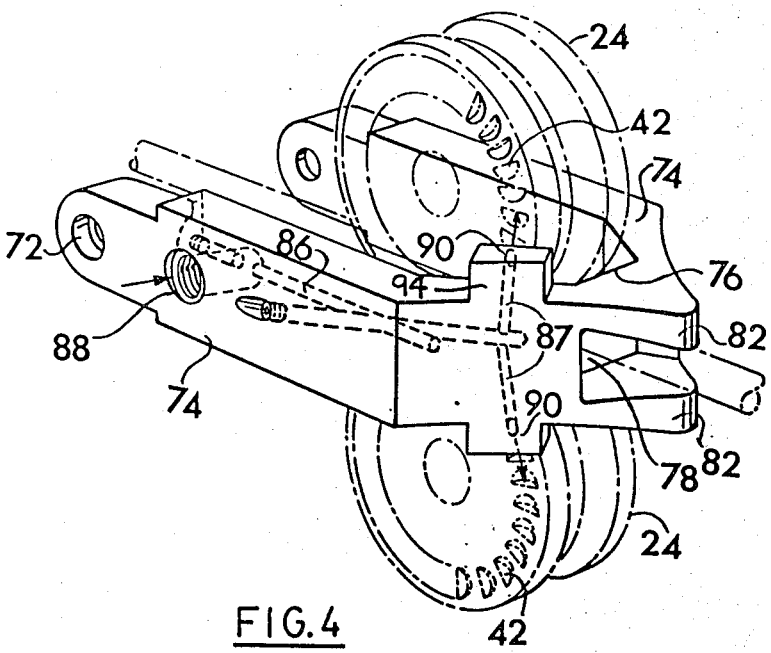
FIG. 4 is a perspective view of means for feeding pressurized fluid to turn the rollers, said means being shown detached from the main apparatus for clarity.

Referring now particularly to FIGS. 2 and 3, an assembly of the invention consists of a body 18 having at its entry end a flange 20 by which it is mounted in the mill and a funnel shaped guide member 22 that guides the entering rod 12 to the passageway in the body through which it passes. Two guide rollers 24 receive the exiting rod to guide it into the next die, usually constituted by a pair of tungsten carbide work rolls (not shown), and each roller is mounted at the end of a respective rocker arm 26 that is pivoted to the body by a pivot pin 28, the axes of the two pins being parallel to one another. The spacing between the peripheries of the two rollers is adjusted by means of screws 30 and 32 in each arm, on opposite sides of the pivot pin, which engage cooperating internal surfaces of the body, the screws holding the arm firmly in its adjusted position for rotation against movement about the pin 28.

Each roller 24 is mounted at the end of its respective rocker arm by a massive screw-threaded bolt 34, carrying a pair of spaced roller bearings 36, which in turn carry a roller periphery portion 38. The radially outermost surface of this roller portion 38 is grooved at 40 to correspond to the diameter of the rod 12, while the two annular side walls of the portion are each provided with a ring of fluid reaction members, constituted in this particular embodiment by scoop-shaped, or approximately semi-spherical shaped, recesses 42, the straight sides of these recesses constituting the leading edges thereof. The reaction members could instead be constituted by projections, and can be any other suitable shape as will be apparent from the description of their function.

A substantially U-shaped yoke 70 is secured to the body 18 by clamping means 80 through holes 72 in the end of arms 74 of the U. The clamps 18 are located such that the plane of the U-shaped yoke 70 contains the axis of rod 12 and is perpendicular to the plane containing the rocker arms 26. The arms of the yoke 70 merge into the web 76 which includes a passage 78 therethrough aligned with the axis of rod 12 to permit feeding of rod 12 therethrough. The web 76 is provided with forwardly projecting nose portions 82 defining a continuation of passage 78 therebetween. These nose portions 82 may act as guides for the rod 12. Arms 74 of bracket 70 are provided with lugs 94 extending towards the forward curves of respective rollers 24. Within the thickness of one arm 74 and lug 94 is provided a bore 86 having an inlet 88 and branching within the web to form two branch bores 87. Each branch bore 87 has an outlet 90. Each outlet 90 is arranged to direct a stream of pressurized fluid at recesses 42 to turn the respective roller 24 and may be provided with appropriately shaped nozzles. The bores 86 are connected through their outlets 90 through connector 92 to an external source (not shown) of compressed fluid, for example compressed air.

The various bores are formed by drilling straight bores in the approximate parts of yoke 70 at appropriate angles and later plugging unwanted portions thereof. It will be noted that both sides of the member 38 are provided with a respective ring of recesses 42, although only the recesses at one side are used, so that the rollers can be used interchangeably on either side of the guide.

Referring especially to FIG. 3, in a special roller bearing structure of this invention the bolt 34 is headed with the head 50 thereof engaged in a bore 52 in one arm of a yoke formed at the end of the respective arm 26. The pin passes through a spacing washer 54 then through the inner race of one bearing 36, through an intervening spacing washer 56, then through the inner race of the other bearing 36, and finally carries a clamp nut 58 which clamps the entire assembly tightly on the bolt 34, the nut being engaged in a corresponding recess. It will be noted that the outer races of the bearings are not of uniform external diameter, but instead have radially-extending outer portions 62 at one side of greater diameter that fit within cooperating annular counterbores 64 in the portion 38, while the remaining portions 66 of the external outer race surfaces fit within uniform bore 68 in the portion 38, so that the bearings are automatically accurately assembled with the portion 38 as it is mounted thereon.

As described above the rollers are worn rapidly in ordinary use, but such wear is considerably reduced with an assembly of the invention. Thus, during operation of the mill pressurised air at about 3.5–5.0 Kg/sq.cm. (50–70p.s.i.) is fed to the outlets 90, causing the rollers to spin at about the speed that they attain as the rod 12 is passing therethrough. The passage of the rod therefore causes little or no acceleration of the rollers, with a consequent absence of skidding between the rod and the rollers and reduction in wear. The invention also provides a positive indication as to the state of the roller bearings by simple visual inspection; the rollers must always be rotating and at substantially the same speed as one another; absence of rotation of any substantial difference in rotational speed indicates that the bearing is sufficiently worn to justify replacement before it seizes further and causes a cobble in the rod.

Disassembly of the roller and the assembly of a new roller is simply a matter of removing nut 58 from bolt 34, taking the roller apart and replacing the member 38, which can be economically produced by casting and subsequent machining of the bore 68 and the counterbores 64. Upon reassembly the bearings are automatically located relative to the roller periphery portion 38, considerably reducing the entire cost of repair and/or replacement.

I claim:

1. A roller entry guide for a rod mill comprising:

a body providing a rod passage therein through which the rod passes;

a pair of rocker arm members mounted by the body on opposite sides of the rod passage for pivoting rocking movement about respective parallel pivot axes;

a pair of guide roller members each mounted by the respective rocker arm member for rotation about a respective rotation axis, the pivoting rocking movement of the arm members permitting movement of the guide roller members toward and away from one another;

each guide roller member having a ring of fluid reaction members coaxial with its axis of rotation;

means disposed to direct a stream of fluid at the said ring of fluid reaction members to rotate the respective guide roller member about its axis of rotation; said means comprising a U-shaped bracket secured to said body through arms thereof and having the plane containing said arms perpendicular to a plane containing the rocker arms, a bore being provided in at least one of said arms and having an inlet to receive pressurised fluid and an outlet to direct a stream of fluid at said ring of fluid reaction members, and means for feeding fluid to the said inlet whereby the guide roller members can be rotated at about their operative speeds prior to engagement by a rod passing through the device by impingement of fluid with said fluid reaction members.

2. A roller entry guide as claimed in claim 1, wherein the said ring of fluid reaction members consists of a ring of scoop shaped recesses in the peripheral portion of the roller member.

3. A roller entry guide as claimed in claim 1, wherein each guide roller member has two rings of fluid reaction members on opposite sides thereof, one only of said rings being engaged by the streams of fluid issuing from said outlet.

4. A roller entry guide as claimed in claim 1, wherein each guide roller member comprises:

a central member; to mount said guide roller member to the respective rocker arm;

a pair of spaced bearing assemblies having their inner races mounted on the central member;

an annular outer member having the said fluid reaction members formed thereon and a central bore extending therethrough to receive the outer races of the bearing;

wherein the bearings have radially projecting parts engaged in respective counterbores in the central bore to locate the bearings axially with respect to said outer member.

5. A roller entry guide as claimed in claim 1 wherein said bore includes a pair of oppositely directed conduits intersecting opposed surfaces of said one arm to direct a stream of fluid at each of said fluid reaction members to induce rotation of said guide roller members in opposite directions.

6. A roller entry guide as claimed in claim 5 wherein an upstanding lug is formed on each of said opposed surfaces of said one arm and said conduits pass through said lug to merge in close proximity to said fluid reaction members.

7. A roller entry guide according to claim 6 wherein said arms of said U shaped bracket are interconnected by a bight having an aperture therethrough to permit passage of a rod.

* * * * *